US005513950A

United States Patent [19]

Yu

[11] Patent Number: 5,513,950

[45] Date of Patent: May 7, 1996

[54] AUTOMOTIVE FUEL PUMP WITH REGENERATIVE IMPELLER HAVING CONVEXLY CURVED VANES

[75] Inventor: Dequan Yu, Ann Arbor, Mich.

[73] Assignee: Ford Motor Company, Dearborn, Mich.

[21] Appl. No.: 363,799

[22] Filed: Dec. 27, 1994

[51] Int. Cl.[6] ..... F04D 17/06

[52] U.S. Cl. ..... 415/55.1

[58] Field of Search ..... 415/55.1, 55.2, 415/55.3, 55.4, 55.5

[56] References Cited

U.S. PATENT DOCUMENTS

| | | | |
|---|---|---|---|
| 3,917,431 | 11/1975 | Rose . | |
| 5,265,996 | 11/1993 | Westhoff et al. . | |
| 5,372,475 | 12/1994 | Kato et al. | 415/55.1 |
| 5,407,318 | 4/1995 | Ito et al. | 415/55.1 |
| 5,409,357 | 4/1995 | Yu et al. | 415/55.1 |

FOREIGN PATENT DOCUMENTS

| | | |
|---|---|---|
| 2738208 | 5/1978 | Germany . |
| 57-97097 | 6/1982 | Japan . |
| 59-82599 | 5/1984 | Japan . |
| 1-177489 | 7/1989 | Japan . |

*Primary Examiner*—John T. Kwon

*Attorney, Agent, or Firm*—N. P. Ferraro; R. L. May

[57] ABSTRACT

A fuel pump (10) has a housing (12) which houses a motor (14) with a shaft (16) extending therefrom and an impeller (18) fitted thereupon for pumping fuel from a fuel tank to an internal combustion engine. The impeller (18) has a plurality of radially extending curved vanes (30) on an outer circumference (34) separated by a plurality of partitions (32) interposed between the vanes (30), the vanes (30) and partitions (32) defining a plurality of partly elliptical vane grooves (50). The vanes (30) are convexly curved in the direction of rotation (40) and have an obtuse inlet angle ($\theta_1$) and an acute outlet angle ($\theta_2$).

9 Claims, 1 Drawing Sheet

AUTOMOTIVE FUEL PUMP WITH REGENERATIVE IMPELLER HAVING CONVEXLY CURVED VANES

FIELD OF THE INVENTION

The present invention relates to automotive fuel pumps, and, more particularly, to a regenerative turbine type rotary impeller with curved vanes.

DESCRIPTION OF THE RELATED ART

Regenerative turbine fuel pumps in automobiles are generally useful for providing relatively high pressure at moderate flow rates. These pumps typically utilize an impeller or similar rotary pumping element. The impeller is located within a pump housing and is rotated about an axis normal to the plane of the impeller through some rotating means such as a shaft attached to a motor. Vanes on the outer circumference of the rotating impeller and vane grooves formed by partitions between the vanes cause the fuel to whirl about in vortices, adding momentum to the fuel which can later be converted into a pressure increase.

Because the shape of the vanes and vane grooves influence the vortices, they directly affect the efficiency of the fuel pump. In addition, the complexity of the shape of the vanes and vane grooves can increase the cost of manufacturing the impeller. If it is desirable to operate the fuel pump at high efficiency, then selection of vane geometry may become a tradeoff between pump efficiency and manufacturing feasibility. Further, impeller geometries which increase the impact between the moving fuel vortices and the impeller vanes or pump walls can introduce turbulence that reduces pump efficiency. For example, Japanese Patent 1-177489 (Mine) discloses an impeller with straight vanes. Points along the straight vanes of the rotating impeller have different linear velocities depending on their distance from the impeller center, which may introduce turbulence and thereby decrease efficiency.

It would be desirable to have an automotive fuel pump with a regenerative impeller featuring geometry that optimizes pump efficiency.

SUMMARY OF THE INVENTION

The present invention provides a regenerative fuel pump for supplying fuel from a fuel tank to an automotive engine, with the fuel pump comprising a pump housing, a rotary pumping element, such as an impeller, within the housing for pumping the fuel, and a means for rotating the pumping element, such as a shaft extending through the element and a motor which rotates the shaft. The pumping element has a plurality of radially extending curved vanes around an outer circumference with a plurality of partitions interposed between the vanes. The vanes are curved convexly with respect to the direction of rotation such that the inlet angle of the vane is obtuse and the outlet angle of the vane is acute.

The principal object of the present invention is to provide a new and improved automotive fuel pump with regenerative impeller. More specifically, it is an object of the present invention to improve pump efficiency. The automotive fuel pump with regenerative impeller having convexly curved vanes is particularly useful for improving pump efficiency in a cost-feasible manner. Other objects, features, and advantages will be apparent from a study of the following written description and drawings.

DETAILED DESCRIPTION OF THE PREFERRED EMBODIMENTS

Figure 1:
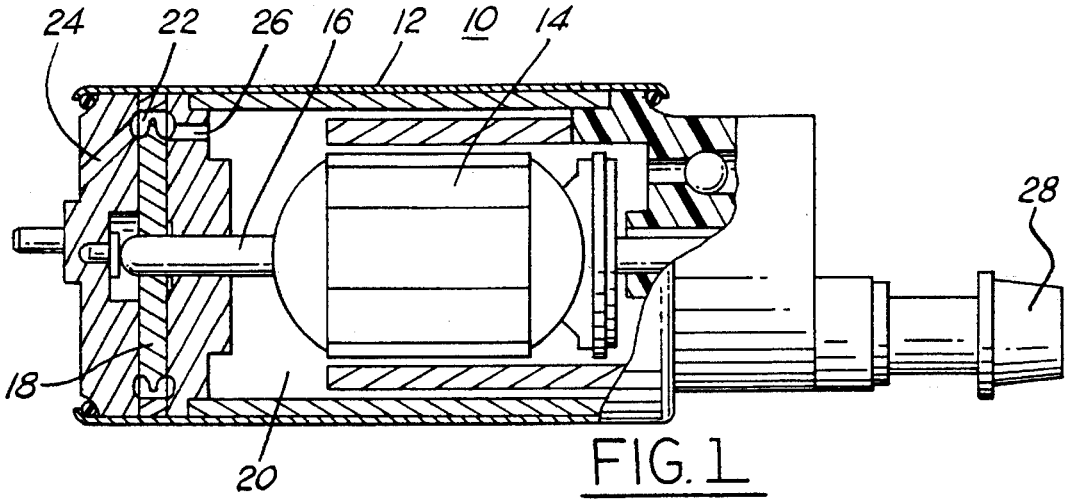
FIG. 1 is a cross-sectional view of a fuel pump having a rotary pumping element according to the present invention.

Referring now to FIG. 1, fuel pump 10 has housing 12 within which its components are housed. Electric motor 14 and shaft 16 are mounted within the pump housing 12 in motor area 20. A rotary pumping element, preferably an impeller 18, is fitted on shaft 16, which rotates impeller 18 within pumping chamber 22. Pumping chamber 22 has fuel inlet 24 connecting pumping chamber 22 to a fuel supply such as a fuel tank (not shown). Pumping chamber 22 also has chamber outlet 26 in fluid connection with motor area 20. Fuel is drawn into the pumping chamber 20 through fuel inlet 24 by impeller 18 and is discharged through chamber outlet 26 into motor area 20 where it cools motor 14 while passing over it to fuel pump outlet 28.

Figure 2:
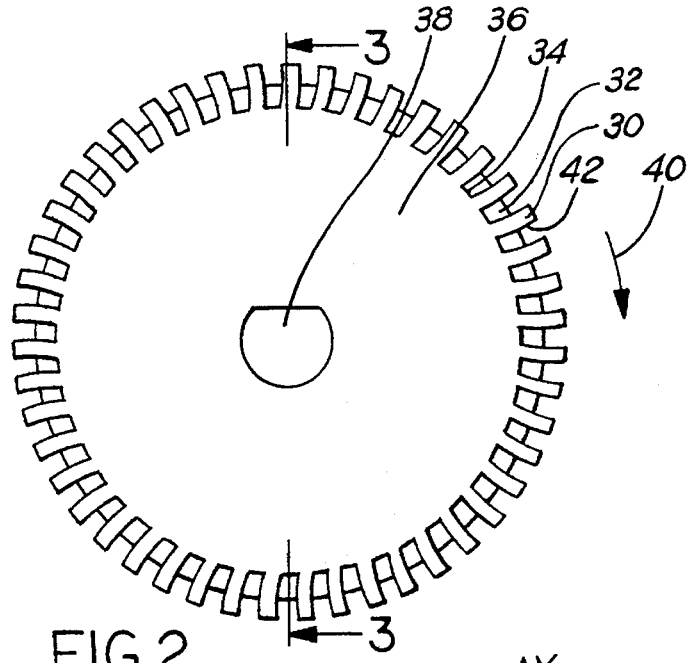
FIG. 2 is a view of a rotary pumping element according to the present invention.

FIG. 2 shows impeller 18 of FIG. 1. Vanes 30 are convexly curved with respect to the direction of rotation, shown by arrow 40, such that leading edge 42 radially leads vane 30 when rotating. Vanes 30 extend radially outward from outer circumference 34 of impeller core 36. The convex curvature of vanes 30 improves pump efficiency, reducing turbulence associated with pushing vortices of fuel, as shown by arrow 60 in FIG. 4.

Referring now to FIG. 2, partitions 32 extend outward from outer circumference 34 and separate vanes 30 with vanes 30 being radially longer than partitions 32. Impeller 18 is slip-fitted to shaft 16 by means of bore 38 formed in impeller core 36. While impeller 18 preferably has a plurality of vanes 30, which is a prime number such as 43, 47, 53, or the like, composite numbers are also acceptable. Prime numbers of vanes reduce fuel pump pulsation and vibration, which in turn reduce noise.

Figure 3:
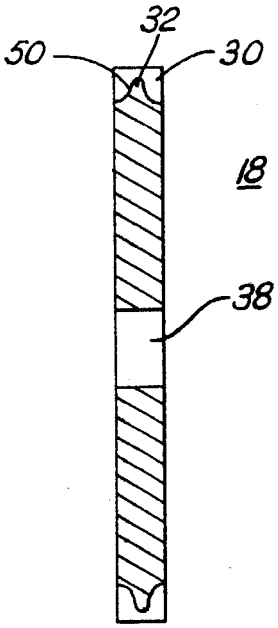
FIG. 3 is a sectional view along line 3—3 of FIG. 2 showing a vane and vane grooves formed by vane-separating partitions.

FIG. 3 is a sectional view of impeller 18 along line 3—3 of FIG. 2 showing bore 38, vanes 30, and partitions 32, which separate vanes 30. Vane grooves 50 are formed by the intersection of partitions 32 and vanes 30.

Figure 4:
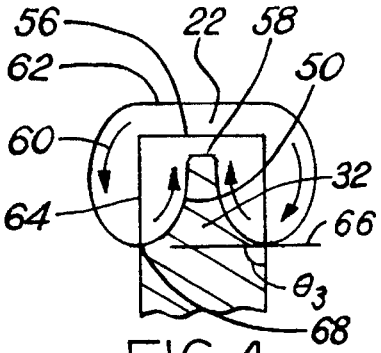
FIG. 4 is a close-up of the vane grooves of FIG. 3 showing a preferred embodiment utilizing a piece of an ellipse as the shape of each groove.
Figure 6:
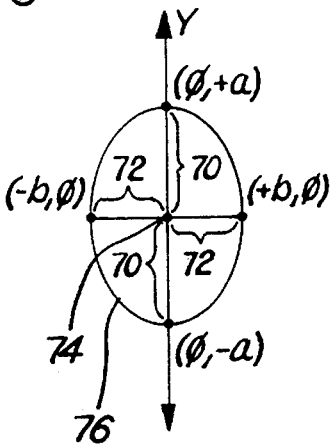
FIG. 6 illustrates a typical ellipse with major and minor shafts.

FIG. 4 shows a detailed close-up of the vane grooves 50. Vane 30, preferably rectangular in shape, intersects partition 32 such that vane grooves 50 are formed. Rotation of impeller 18 creates vortices, shown by arrow 60, in the fluid, which are influenced by the shape of vane grooves 50. Each vane groove 50 is preferably shaped as a straight line of approximately 0.1 millimeters to 1.0 millimeters for impeller 18 with thirty millimeter diameter, plus a piece of an ellipse of the form $x^2/b^2+y^2/a^2=1$, as shown in FIG. 6, where major shafts 70 and minor shafts 72 of ellipse 76 preferably maintain a ratio a:b of at least 1:1 but not more than 3:2.

While a preferred embodiment utilizes partly elliptical vane grooves 50 (FIG. 4), other geometries may also be used. Partly elliptical vane grooves 50 reduce the separation between pump chamber boundary 62 and vortices, as shown by vortices arrow 60, improving pump efficiency. Also, while a preferred embodiment utilizes a ratio of 1:1 to 3:2 between ellipse's major shafts 70 and minor shafts 72, ratios outside this range may also be used. Ratios within this range create a more radially symmetric vortex, improving pump efficiency.

Referring still to FIG. 4, each vane groove 50 preferably intersects the lateral edge 64 of the vane 30 such that a tangent 66 to the vane groove 50 at the point of intersection forms an angle $\theta_3$ of approximately ninety degrees. While a preferred embodiment utilizes ninety degrees, angles of greater sizes may also be used. Ninety degree angles reduce the turning losses that can arise due to turbulence caused by the impact of fluid flowing in a vortex 60 against the vane groove edge 68. Angles of less than ninety degrees can increase the impact between the moving fuel vortices 60 and the vane groove edge 68, introducing turbulence, which reduces pump efficiency.

The vane grooves 50, as shown in FIG. 4, are preferably joined by flat top with rounded edges 58, which is preferably spaced between one-half millimeter and two millimeters from end edge 56 of vane 30 for impeller 18 with a thirty millimeter diameter. Such spacing makes vortex 60 more symmetric, reducing losses due to turbulence caused by fluid impacting against pump chamber boundary 62. Also, such spacing minimizes turbulence associated with fuel crossing over partition 32 from one vortex 60 to another. This crossing must take place because fuel inlet 24, as shown in FIG. 1, is on the opposite side of impeller 18 from chamber outlet 26. While a preferred embodiment utilizes one-half millimeter to two millimeter spacing for impeller 18 with thirty millimeter diameter, spacing outside this range may also be used.

Figure 5:
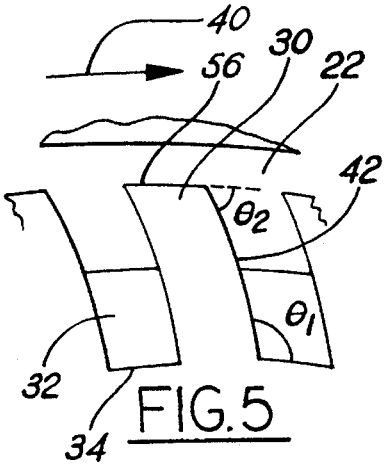
FIG. 5 is a close-up of a vane of FIG. 2 showing the obtuse inlet angle and acute outlet angle created by the curvature of the vane.

FIG. 5 is a close-up of vane 30 showing inlet angle $\theta_1$ and outlet angle $\theta_2$. Inlet angle $\theta_1$, so named because vortex 60, as shown in FIG. 4, flows inward towards partition 32 near inlet angle $\theta_1$, is formed between leading edge 42 and outer circumference 34. Outlet angle $\theta_2$, so named because vortex 60, as shown in FIG. 4, flows outward from partition 32 near outlet angle $\theta_2$, is formed between leading edge 42 and an extension of end edge 56. Inlet angle $\theta_1$ is obtuse, and outlet angle $\theta_2$ is acute. While a preferred embodiment utilizes values of one hundred angular degrees (100°) for $\theta_1$ and eighty angular degrees (80°) for $\theta_2$, other values may be used, so long as inlet angle $\theta_1$ is obtuse and outlet angle $\theta_2$ is acute. Values of one hundred angular degrees for $\theta_1$ and eighty angular degrees for $\theta_2$ are preferred for minimizing losses due to turbulence.

FIG. 6 shows ellipse of the form $x^2/b^2+y^2/a^2=1$ on a two-dimensional mathematical scale, in order to clarify the description of a preferred embodiment with respect to FIG. 4. Vertices {(O,+a) (O,–a)} and covertices {(+b,O) (–b,O)} are such that the ratio a:b is at least 1:1 but not more than 3:2. Major shafts 70 and minor shafts 72 extend from ellipse center 74 to ellipse boundary 76.

From the foregoing description, one ordinarily skilled in the art can easily ascertain the essential characteristics of this invention and, without departing from the spirit and scope of the claims, can make various changes and modifications to the invention to adapt it to various usages and conditions.

What is claimed is:

1. A regenerative pump for supplying fuel to an engine from a fuel tank, the pump comprising:

a pump housing;

a rotary pumping element rotating within the pump housing comprising:

a core having an outer circumference;

a plurality of curved vanes radially extending around the outer circumference of the core, each said vane member comprising a leading edge having and end adjacent the core, and an outer edge adjacent the leading edge at an end opposite the core, the outer edge thereby defining an outer circumference of the rotary pumping element;

a plurality of partitions interposed between the curved vanes; and, the leading edge of the curved vanes being convex with respect to the direction of rotation of the rotary pumping element such that an inlet angle formed between the leading edge and the outer circumference of the core is obtuse, while an outlet angle formed between the leading edge and a line tangent to the outer circumference of the rotary pumping element at an intersection of the leading edge and the outer edge is acute; and, means for rotating the rotary pumping element.

2. A regenerative pump according to claim 1, wherein the plurality of vanes and partitions intersect to define a vane groove which is shaped as part of an elliptic curve such that major and minor shafts of the ellipse maintain a ratio of not more than 3:2.

3. A regenerative pump according to claim 2, wherein the vane grooves intersect the lateral edges of the vanes at right angles.

4. A regenerative pump according to claim 1, wherein the number of curved vanes is a prime number.

5. A regenerative pump for supplying fuel to an engine from a fuel tank, the pump comprising:

a pump housing;

a motor housed within the pump housing;

a shaft extending axially from the motor; and an impeller fitted to the shaft, rotating within the pump housing comprising:

a core having an outer circumference;

a plurality of curved vanes radially extending around the outer circumference of the core, each said vane comprising a leading edge having an end adjacent the core, and an outer edge adjacent the leading edge at an end opposite the core, the outer edge thereby defining an outer circumference of the impeller;

a plurality of partitions interposed between the curved vanes such that the vanes and partitions define a plurality of partly elliptical vane grooves; and, the leading edge of the curved vanes being convex with respect to the direction of rotation of the impeller such that an inlet angle formed between the leading edge and the outer circumference of the core is obtuse, while an outlet angle formed between the leading edge and a line tangent to the outer circumference of the impeller at an intersection of the leading edge and outer edge is acute.

6. A regenerative pump according to claim 5, wherein each partly elliptical vane groove defines a part of an elliptic curve such that major and minor shafts of the ellipse maintain a ratio of not more than 3:2.

7. A regenerative pump according to claim 6, wherein the partly elliptical vane grooves intersect the lateral edges of the vanes at right angles.

8. A regenerative pump according to claim 5, wherein the number of curved vanes is a prime number.

9. An impeller for use in a regenerative pump comprising:

a core having an outer circumference;

a plurality of curved vanes radially extending around the outer circumference of the core, each said vane comprising a leading edge having an end adjacent the core, and an outer edge adjacent the leading edge at an end opposite the core, the outer edge thereby defining an outer circumference of the impeller; and, a plurality of partitions interposed between the curved vanes such that the vanes and partitions define a plurality of partly elliptical vane grooves; and, the leading edge of the curved vanes being convex with respect to the direction of rotation of the impeller, when in use, such that an inlet angle formed between the leading edge and the outer circumference of the core is obtuse, while an outlet angle formed between the leading edge and a line tangent to the outer circumference of the impeller at an intersection of the leading edge and outer edge is acute.

* * * * *